US008613444B2

(12) United States Patent
Hagos, III et al.

(10) Patent No.: US 8,613,444 B2
(45) Date of Patent: Dec. 24, 2013

(54) ROLL NIP STRUCTURE HAVING ADAPTIVE PIVOT POSITION

(75) Inventors: Samuel Hagos, III, London (GB); Benjamin R. Chaplin, London (GB); Christopher F. D. Watts, St. Albans (GB); Ian A. Parks, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/907,133

(22) Filed: Oct. 19, 2010

(65) Prior Publication Data

US 2012/0091654 A1 Apr. 19, 2012

(51) Int. Cl.
*B65H 5/02* (2006.01)

(52) U.S. Cl.
USPC ..... 271/272

(58) Field of Classification Search
USPC ..... 271/272–274, 314
See application file for complete search history.

(56) References Cited

U.S. PATENT DOCUMENTS 1,997,273 A * 4/1935 Barkley ..... 271/38
2,974,952 A * 3/1961 Zeuthen ..... 271/242
4,475,732 A 10/1984 Clausing et al.
4,531,996 A * 7/1985 Sukenik ..... 156/472
4,695,048 A * 9/1987 Gorner et al. ..... 271/122
5,350,102 A 9/1994 de Muijnck et al.
5,351,945 A * 10/1994 Asakawa et al. ..... 271/118
5,421,569 A 6/1995 Davidson
5,709,380 A 1/1998 Petocchi et al.
6,032,004 A 2/2000 Mirabella, Jr. et al.
6,585,253 B1 * 7/2003 Miki ..... 271/125
7,427,061 B2 9/2008 Ruthenberg et al.

FOREIGN PATENT DOCUMENTS

GB 710873 6/1954

* cited by examiner

*Primary Examiner* — Thomas Morrison
(74) *Attorney, Agent, or Firm* — Gibb & Riley, LLC

(57) ABSTRACT

A printing apparatus comprises a marking device, a media path positioned to supply sheets of media to the marking device, and a media supply tray positioned to supply the sheets of media to the media path. Further, a pair of rollers forms a nip adjacent the media supply tray. The rollers rotate in opposite directions to cause the sheets of media to move from the media supply tray to the media path. Additionally, a first frame structure supports a first roller of the pair of rollers. The first frame structure can be in a fixed position and holds the first roller in a fixed location. A second frame structure supports a second roller of the pair of rollers. The second frame structure is adjustable in a first direction toward the first roller and has a variable pivot position allowing the second frame structure to move in a second direction perpendicular to the first direction.

17 Claims, 11 Drawing Sheets

ROLL NIP STRUCTURE HAVING ADAPTIVE PIVOT POSITION

BACKGROUND

Embodiments herein generally relate to printing devices that feed sheets of media on media paths to printing engines that print on the sheets of media, and more particularly to an improved printing device that includes a nip roll structure that actively adjusts the pivot position of a frame member to maintain proper positional relationships between the two rolls that form the nip.

When moving sheets of media along the media path within a printing device, many different devices such as belts, rolls (which are sometimes referred to herein as rollers) etc., can be utilized. One such media movement mechanism is referred to as a "nip" that is formed at a location where opposing rollers contact one another. Within most nip structures, one of the rollers is driven by a motor or other actuator (directly or indirectly), and the other roller has a specifically designed amount of rolling freedom (rolling resistance) and spring loading against the drive roller that helps achieve various design goals for each specific nip. The rollers that make up the nip can be biased against one another using a spring, piston, or other similar biasing member connected to one or both rollers.

SUMMARY

One exemplary printing apparatus herein comprises a marking device, a media path positioned to supply sheets of media to the marking device, and a media supply tray positioned to supply the sheets of media to the media path. Further, a pair of rollers forms a nip adjacent the media supply tray. The rollers rotate in opposite directions to cause the sheets of media to move from the media supply tray to the media path. Additionally, a first frame structure supports a first roller of the pair of rollers. The first frame structure can be in a fixed position and holds the first roller in a fixed location. A second frame structure supports a second roller of the pair of rollers.

The second frame structure is adjustable in a first direction toward the first roller and has a variable pivot position allowing the second frame structure to move in a second direction perpendicular to the first direction. The second frame structure also includes a pivot connection that allows the frame to move in the first direction. A biasing member such as a spring or actuator is connected to the second frame for biasing the second frame in the first direction.

In one embodiment, a series of openings into which the pivot connection connects allow the pivot connection to move in the second direction. In another embodiment, the second frame structure has a slot into which the pivot connection connects that allows the pivot connection to move in the second direction. In an additional embodiment, the second frame structure includes a screw mechanism to which the pivot connection connects, where adjustment of the screw mechanism allows the pivot connection to move in the second direction.

The first roller has a first axis about which the first roller rotates and the second roller has a second axis about which the second roller rotates. A reference line would connect the first axis and the second axis when the first roller and the second roller are not worn and are full size. The second direction would also be perpendicular to the reference line. Further, coordinated movement of the second frame in the first direction and the second direction keeps the second axis on this reference line as the size of the first roller and the second roller decrease because of wear.

Another exemplary printing apparatus herein comprises a marking device, a media path positioned to supply sheets of media to the marking device, and a media supply tray positioned to supply the sheets of media to the media path. Further, the media path includes a pair of rollers that form a nip. The rollers rotate in opposite directions to cause the sheets of media to move along the media path. Additionally, a first frame structure supports a first roller of the pair of rollers. The first frame structure can be in a fixed position and holds the first roller in a fixed location. A second frame structure supports a second roller of the pair of rollers.

The second frame structure is adjustable in a first direction toward the first roller and has a variable pivot position allowing the second frame structure to move in a second direction perpendicular to the first direction. The second frame structure also includes a pivot connection that allows the frame to move in the first direction. A biasing member such as a spring or actuator is connected to the second frame for biasing the second frame in the first direction.

In one embodiment, a series of openings into which the pivot connection connects allow the pivot connection to move in the second direction. In another embodiment, the second frame structure has a slot into which the pivot connection connects that allows the pivot connection to move in the second direction. In an additional embodiment, the second frame structure includes a screw mechanism to which the pivot connection connects, where adjustment of the screw mechanism allows the pivot connection to move in the second direction.

The first roller has a first axis about which the first roller rotates and the second roller has a second axis about which the second roller rotates. A reference line would connect the first axis and the second axis when the first roller and the second roller are not worn and are full size. The second direction would also be perpendicular to the reference line. Further, coordinated movement of the second frame in the first direction and the second direction keeps the second axis on this reference line as the size of the first roller and the second roller decrease because of wear.

An additional exemplary apparatus herein comprises a nip structure that includes a pair of rollers that form a nip. The rollers rotate in opposite directions to cause the sheets of media to move along a media path. Additionally, a first frame structure supports a first roller of the pair of rollers. The first frame structure can be in a fixed position and holds the first roller in a fixed location. A second frame structure supports a second roller of the pair of rollers.

The second frame structure is adjustable in a first direction toward the first roller and has a variable pivot position allowing the second frame structure to move in a second direction perpendicular to the first direction. The second frame structure also includes a pivot connection that allows the frame to move in the first direction. A biasing member such as a spring or actuator is connected to the second frame for biasing the second frame in the first direction.

In one embodiment, a series of openings into which the pivot connection connects allow the pivot connection to move in the second direction. In another embodiment, the second frame structure has a slot into which the pivot connection connects that allows the pivot connection to move in the second direction. In an additional embodiment, the second frame structure includes a screw mechanism to which the pivot connection connects, where adjustment of the screw mechanism allows the pivot connection to move in the second direction.

The first roller has a first axis about which the first roller rotates and the second roller has a second axis about which the second roller rotates. A reference line would connect the first axis and the second axis when the first roller and the second roller are not worn and are full size. The second direction would also be perpendicular to the reference line. Further, coordinated movement of the second frame in the first direction and the second direction keeps the second axis on this reference line as the size of the first roller and the second roller decrease because of wear.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
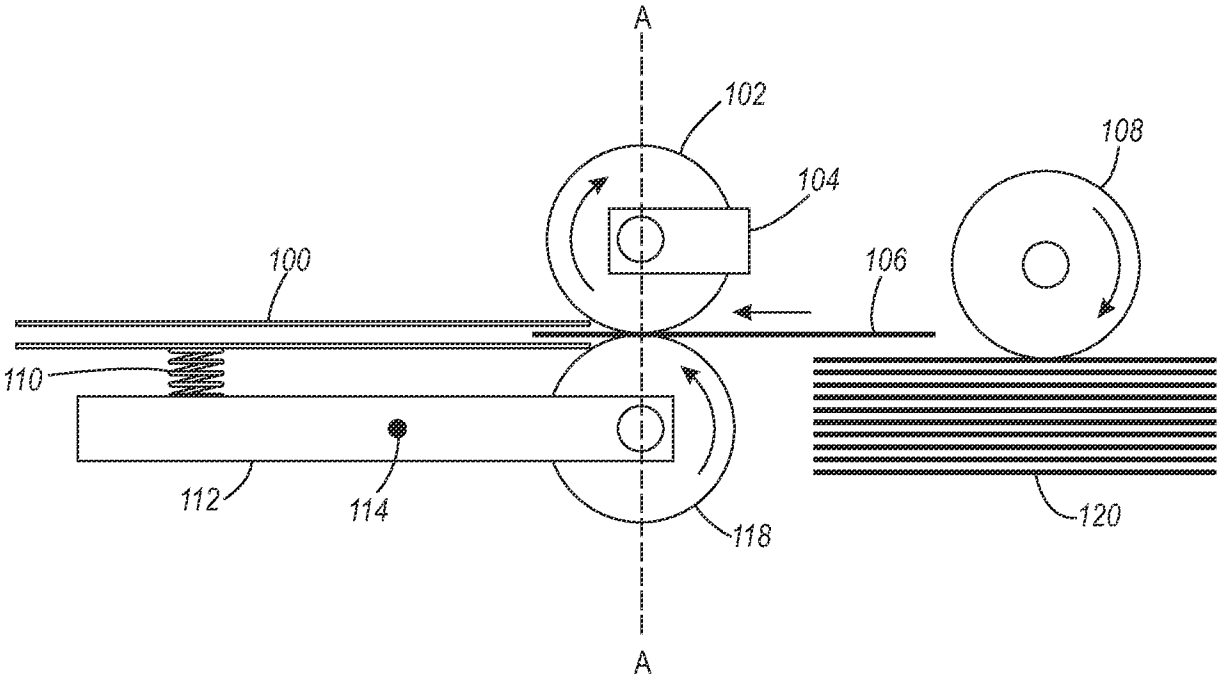
FIG. 1 is a side-view schematic diagram of a device according to embodiments herein.
Figure 2:
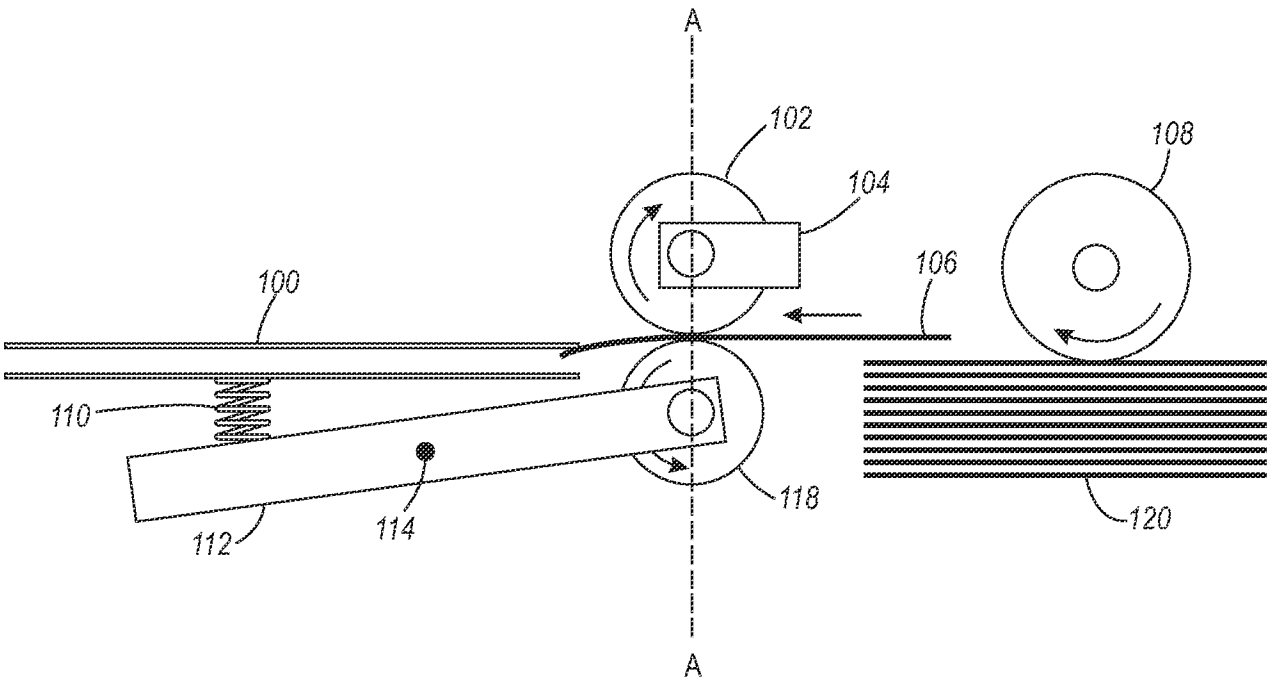
FIG. 2 is a side-view schematic diagram of a nip device according to embodiments herein.

One exemplary nip structure that can be used within printing devices is illustrated in FIGS. 1 and 2. This structure includes a sheet storage area 120 such as a paper tray that stores a stack of sheets 106. One roller 108 (which is sometimes referred to herein as a nudger roller) moves the top sheet 106 from the stack of sheets toward the nip formed between two opposing rollers 102, 118. In this example, the top roller 102 is sometimes referred to as the feed roller or the first roller (which is directly or indirectly driven by a motor or other actuator) and the bottom roller 118 is sometimes referred to herein as the retard roller or the second roller which is biased against the feed roller 102 by the operation of a spring 110 and frame member 112.

The frame member 112 pivots around an axle, pin, or pivot point 114 such that the biasing member 110 causes of the roller 118 to be biased toward the feed roller 102. The axle 114 is generally a low friction cylindrical item that has sufficient strength to support the forces experienced by the frame 112 and can comprise a metal, alloy, plastic, etc. item (any may comprise rolling surfaces, such as roller or ball bearings, etc.). The rotation of the rollers 102, 118 through the nip area causes each sheet of media 106 to be propelled from the sheet storage 120 at a controlled speed along the paper path 100 toward the next item within the printing device that will perform an operation on the sheet of media 106.

FIG. 2 illustrates the same structure shown in FIG. 1 after the rollers 102, 118 have experienced a certain amount of wear which has reduced the diameters of the rollers 102, 118. The dashed reference line A-A has been included in FIGS. 1 and 2 to illustrate how the rollers shift position as they wear (and as their diameters decrease). More specifically, the reference line A-A in FIG. 1 passes through the axis of each of the rollers 102, 118. In FIG. 2, the reference line A-A is in the same position and still passes through the axis of roller 102; however, because the frame 112 pivots in an arc around the pivot point 114, the axis of the roller 118 not only moves up toward the feed roller 102, it also moves away from the reference line A-A.

As shown in FIG. 2, because of the arc movement of the roller 118 away from the reference line A-A, the angle of the nip relative to the linear position of the media path 100 (sometimes referred to as separation nip angle) changes, which can cause the sheet of media 106 to enter the media path 100 at a non-parallel angle, potentially causing damage to the sheet of media. In addition, this change in separation nip angle can result in a higher multi-feed rate (a situation where multiple sheets are inadvertently simultaneously drawn into the nip), which can result in paper jams, etc., as well as misfeeds (where a sheet does not enter the media path when it is required to do so or enters at the wrong angle). Also, changes in the separation nip angle can place excessive loads on the nip (sometimes referred to as nip cramming force) because the separation nip angle is a critical parameter contributing to the dynamic nip load (static load+cramming load).

Thus, the nip angle varies over the life of the nip as the opposing rollers wear and their diameters are reduced, which can cause the issues that are mentioned above. In order to address these issues, as shown in FIGS. 3 and 4, the embodiments herein provide a nip structure that includes a dynamically variable pivot position for the frame member 112 that supports the retard roller 118.

Figure 3:
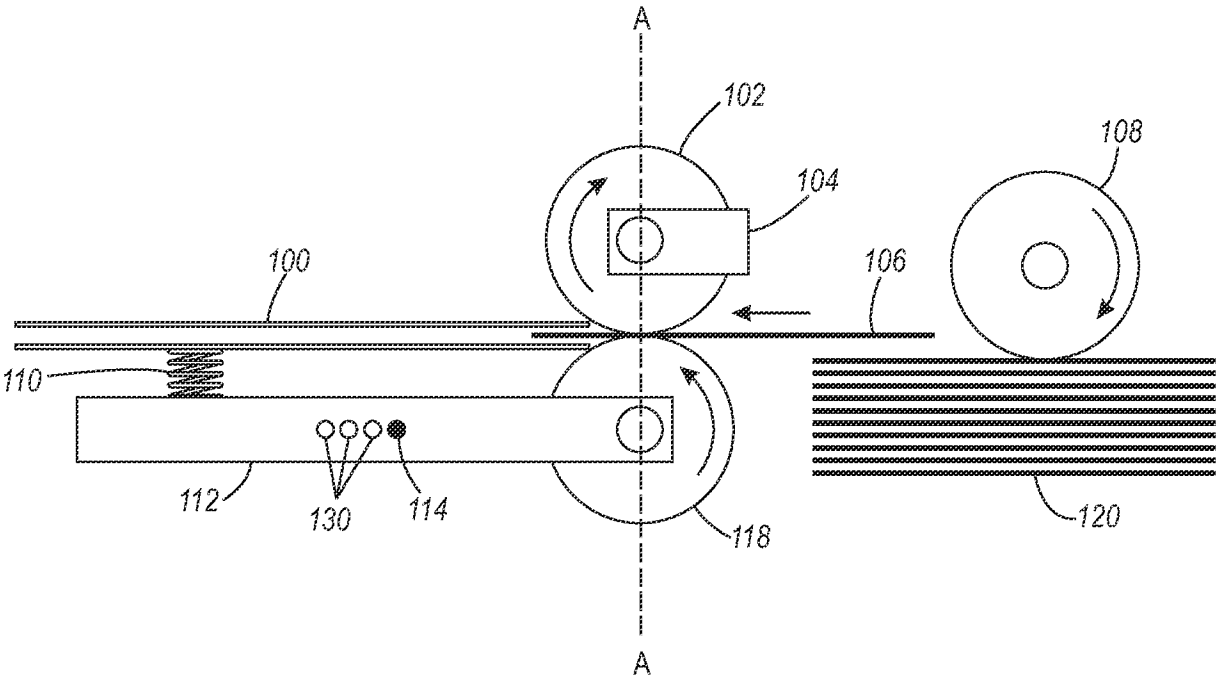
FIG. 3 is a side-view schematic diagram of a nip device according to embodiments herein.
Figure 4:
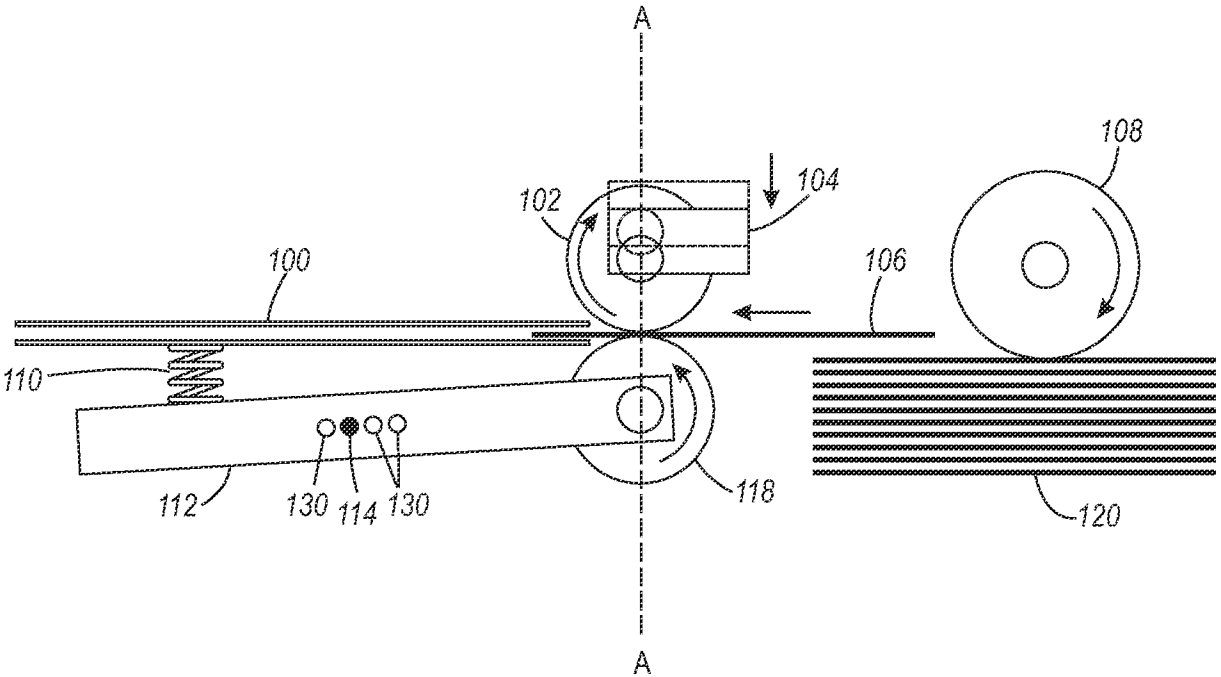
FIG. 4 is a side-view schematic diagram of a nip device according to embodiments herein.

More specifically, as shown in FIGS. 3 and 4, the pair of rollers 102, 118 shown in FIG. 1 again forms a nip. An arbitrarily named top or "first" frame structure 104 supports the first roller 102 of the pair of rollers 102, 118. The first frame structure 104 can be in a fixed position and can hold the first roller 102 in a fixed location or can move up and down, as discussed in additional embodiments discussed below. A lower or "second" frame structure 112 supports the second roller 118 of the pair of rollers 102, 118.

The second frame structure 112 is adjustable in a first direction toward the first roller 102 and has a variable pivot position to compensate for the arc movement the second roller 118 would experience with a single pivot position (FIG. 2). More specifically, the frame structure 112 includes a series of pivot position openings 130 where the axle 114 may be positioned. Therefore, as shown in FIG. 4, this allows the second frame structure 112 to be repositioned to move back toward (in a perpendicular direction to) the reference line A-A. Therefore, the second frame structure 112 not only moves in the first direction toward the feed roller 102 by pivoting around the pivot point 114, the second frame structure 112 can also move in a second direction that is perpendicular to the first direction (e.g., perpendicular to the arc movement and/or perpendicular to the reference line A-A).

With the structure illustrated in FIGS. 3 and 4, an individual performing maintenance upon the printing device can periodically adjust the position of the second frame structure 112 as the diameter of the rollers 102, 118 decrease (due to wear) to allow the axis of the retard roller 118 to remain close to or on the reference line A-A. This reduces the change in separation nip angle and, therefore, decreases the number of issues that are associated with separation nip angle (discussed above). While four pivot position openings 130 are illustrated in FIGS. 3 and 4, those ordinarily skilled in the art would understand that the number of openings could be more or less, depending upon the specific design goals for the structure (and the amount the diameters of the rollers 102, 118 will decrease because of wear).

In an additional embodiment, the position of the first frame structure 104 can also be adjustable as illustrated by the downward arrow in FIG. 4 (as biased by springs, or as adjusted through different mounting positions). The dashed-line drawing of the first frame structure 104 in FIG. 4 denotes the position the first frame number 104 occupied in FIG. 3 before the feed roller 102 experienced wear. By maintaining the axis of both rollers 102, 118 on or close to the reference line A-A and by maintaining the position of the nip centered in the media path 100, the separation nip angle does not change and the issues that are mentioned above are avoided.

Figure 5:
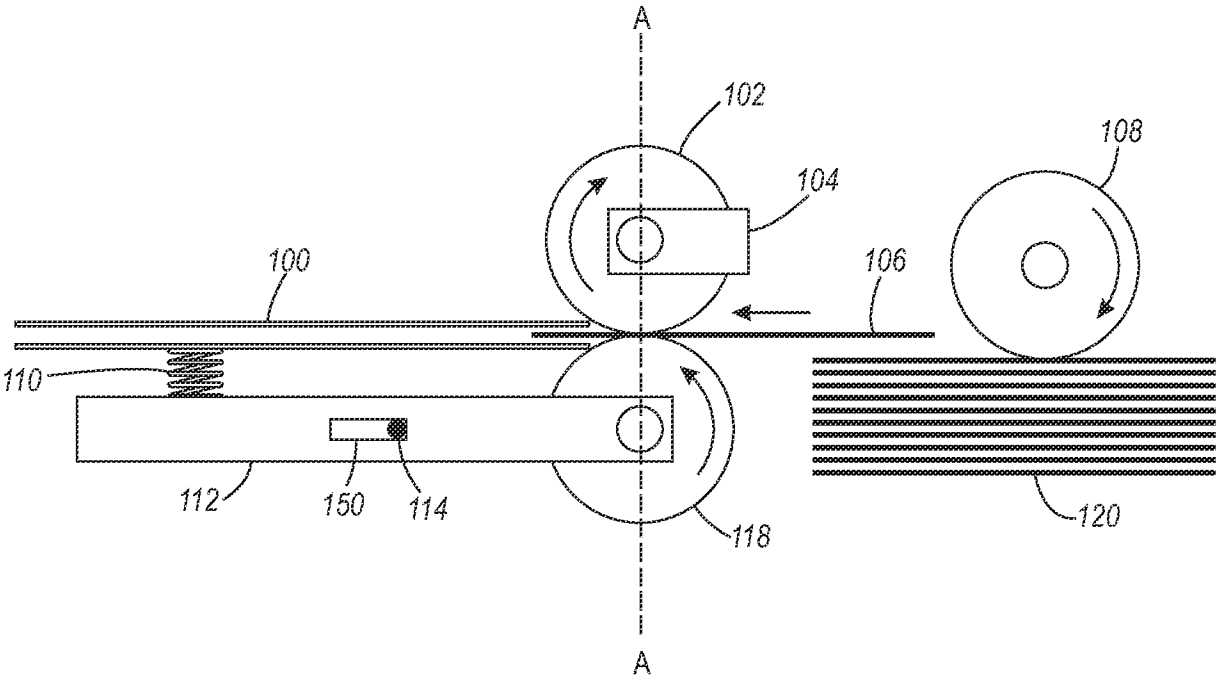
FIG. 5 is a side-view schematic diagram of a nip device according to embodiments herein.
Figure 6:
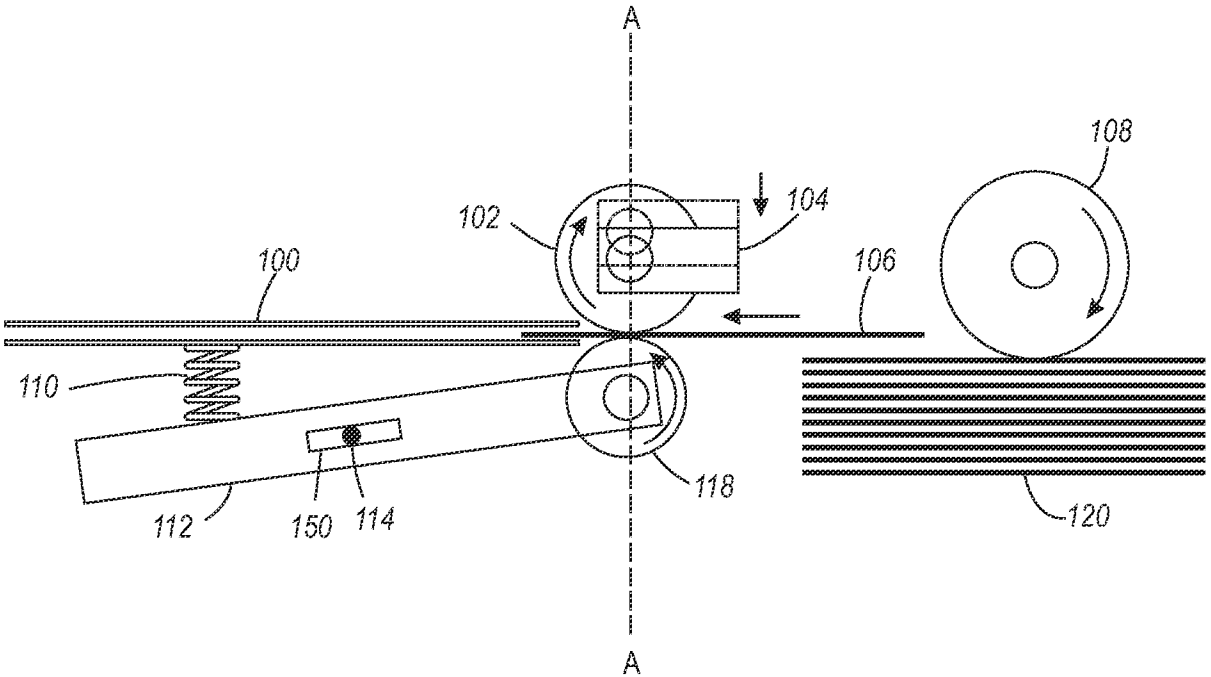
FIG. 6 is a side-view schematic diagram of a nip device according to embodiments herein.

In another embodiment, illustrated in FIGS. 5 and 6, instead of using multiple openings 130 (as is done in FIGS. 3 and 4) the second frame structure 112 has a slot 150 into which the pivot connection 114 connects. The slot illustrated in FIGS. 5 and 6 allows the pivot connection 114 to variably move in the second direction toward or away from the reference line A-A to maintain the axis of the roller 118 in the desirable position. For example, the pivot connection 114 can include a screw, bolt, or other fastener that is used to hold the pivot connection 114 at a fixed position within the slot 150. With such a pivot connection 114, a service engineer can loosen the fastener of the pivot connection 114, adjust the position of the pivot connection 114 within the slot 150, and retighten the pivot connection 114 to variably adjust the pivot point of the second frame structure 112.

Figure 7:
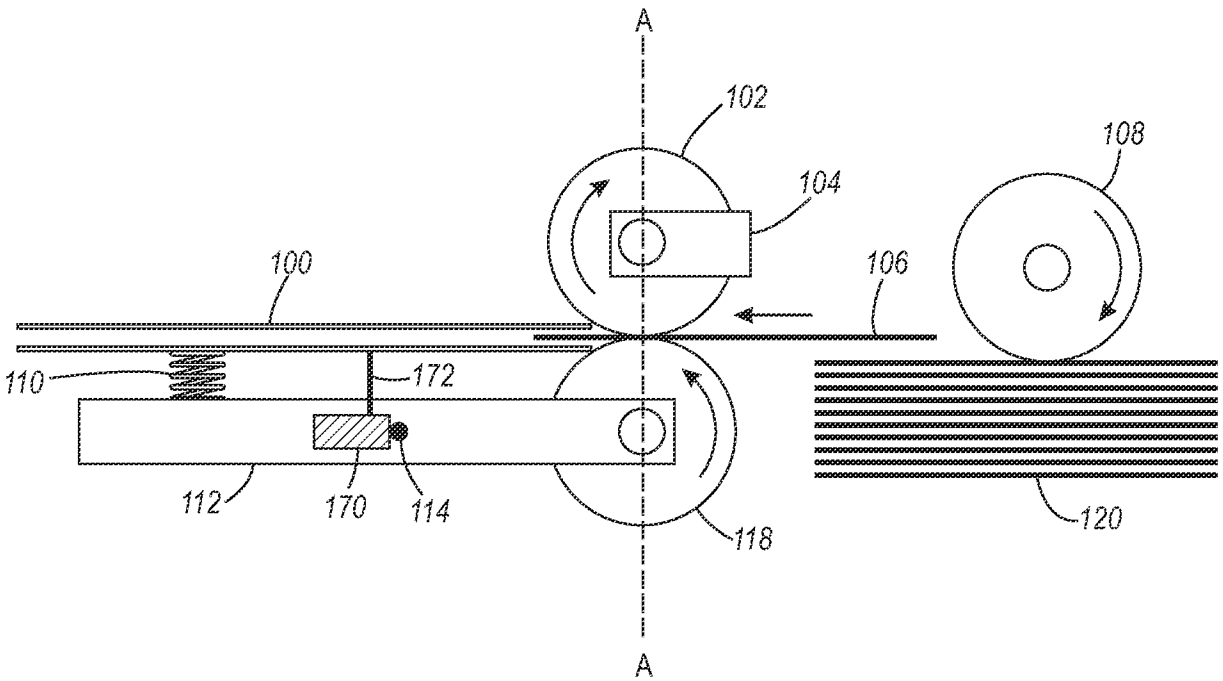
FIG. 7 is a side-view schematic diagram of a nip device according to embodiments herein.
Figure 8:
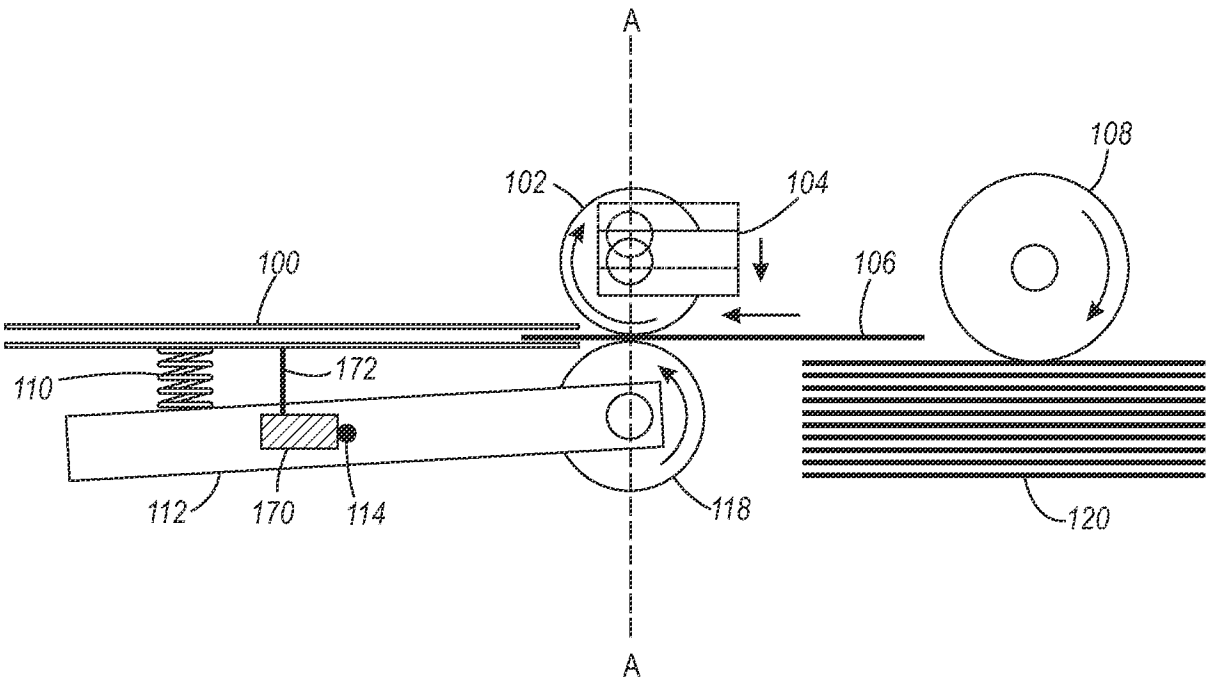
FIG. 8 is a side-view schematic diagram of a nip device according to embodiments herein.

In an additional embodiment illustrated in FIGS. 7 and 8, the second frame structure 112 includes a screw mechanism or linear actuator 170. The screw mechanism/actuator 170 is connected to the pivot connection 114 and adjustment of the screw mechanism/actuator 170 moves the position of the pivot connection, so as to move the second frame structure 112 in the second direction toward the reference line A-A. The screw mechanism/actuator 170 permits a user or service engineer to precisely control the location of the pivot connection 114 so as to maintain the axis of the roller 118 on or close to the reference line A-A. Further, if a powered actuator 170 is utilized, the powered actuator 170 can be controlled by the printer's processor, and the printing device can periodically and automatically change the location of the pivot connection 114 on the second frame member 112 as the diameters of rollers 102, 118 decreases due to wear.

Therefore, as shown above, with embodiments herein, the pivot point 114 on the second frame member 112 that is connected to the retard roller 118 can be automatically or manually changed to provide coordinated movement of the second frame in the first direction and the second direction to keep the second axis on or near (within a predetermined distance of) the reference line A-A as the size of the first roller 102 and the second roller 118 decrease because of wear. Further, the first frame member 104 can be adjusted manually or automatically While the foregoing examples provide a nip that is positioned directly adjacent to the sheets storage area 120, those ordinarily skilled in the art would understand that any of the nips within the printing apparatus could utilize the dynamically positioned pivot point frame to avoid the issues that are caused by increasing separation nip angle, which occurs as the diameters of the nips decreased with wear.

Figure 9:
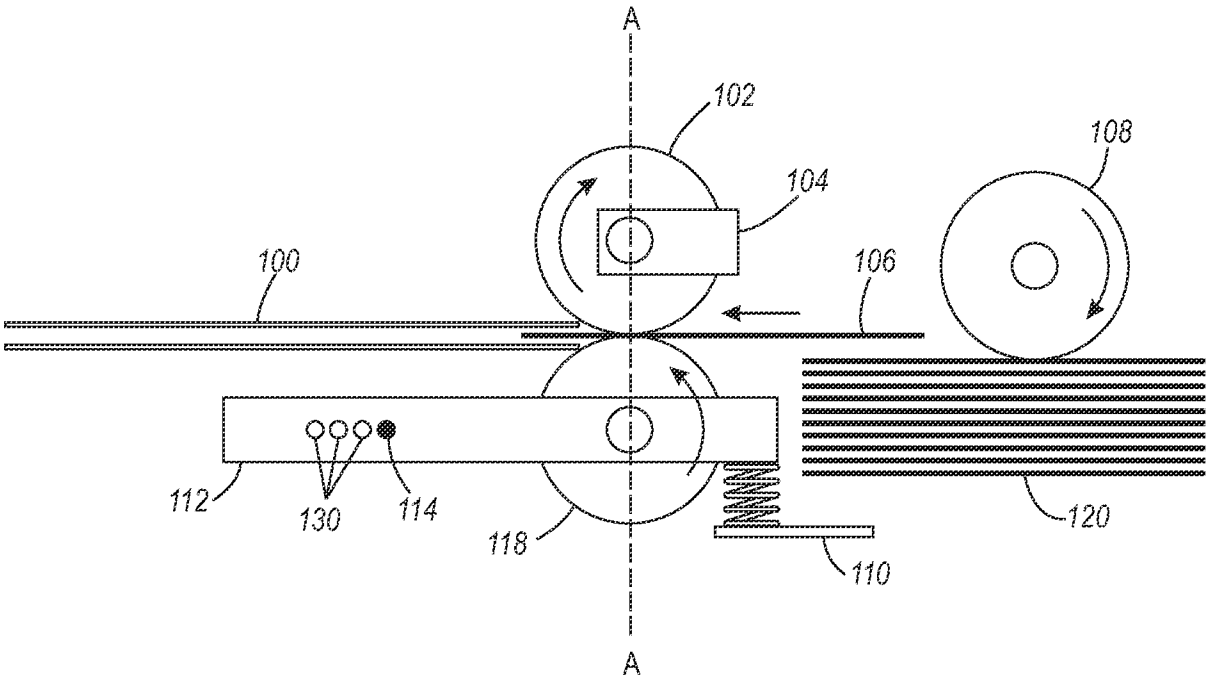
FIG. 9 is a side-view schematic diagram of a nip device according to embodiments herein.
Figure 10:
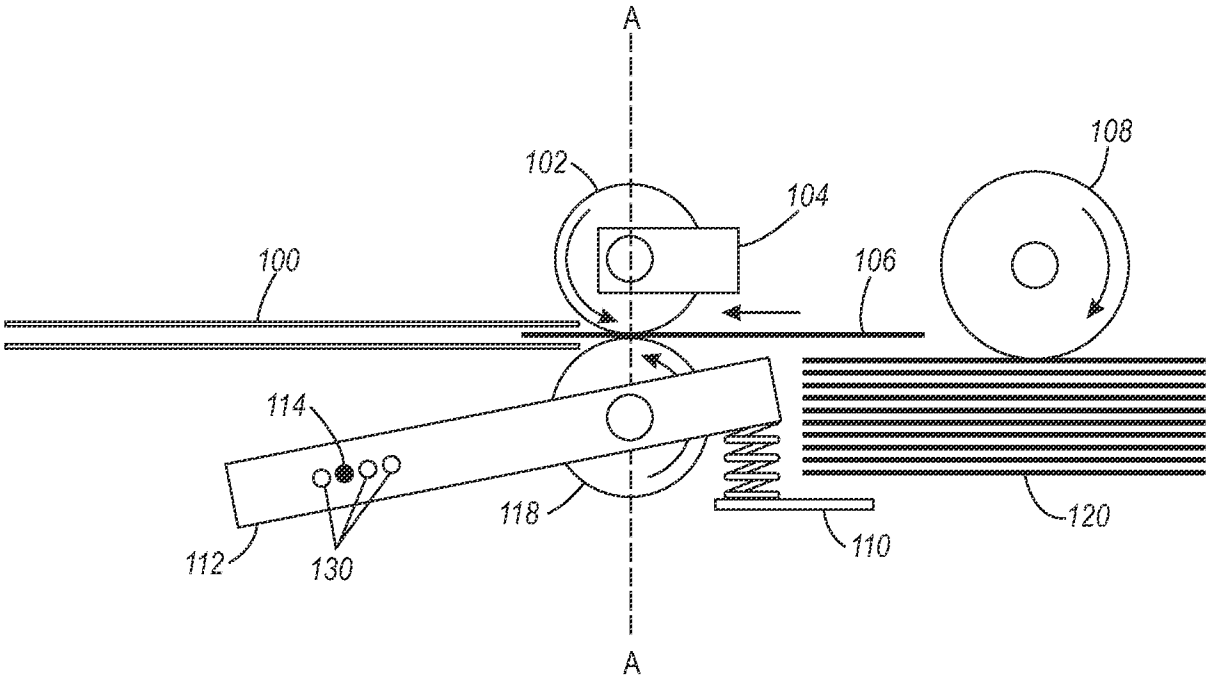
FIG. 10 is a side-view schematic diagram of a nip device according to embodiments herein.

Additionally, different structures, such as the biasing member 110 can be located in different positions. For example, as illustrated in FIGS. 9 and 10, the biasing member 110 can be positioned adjacent to the media tray 120 and supported by a frame member. However, the variable position of the pivot location of the second frame member 112 still accommodates for the roller size change, as described above.

Figure 11:
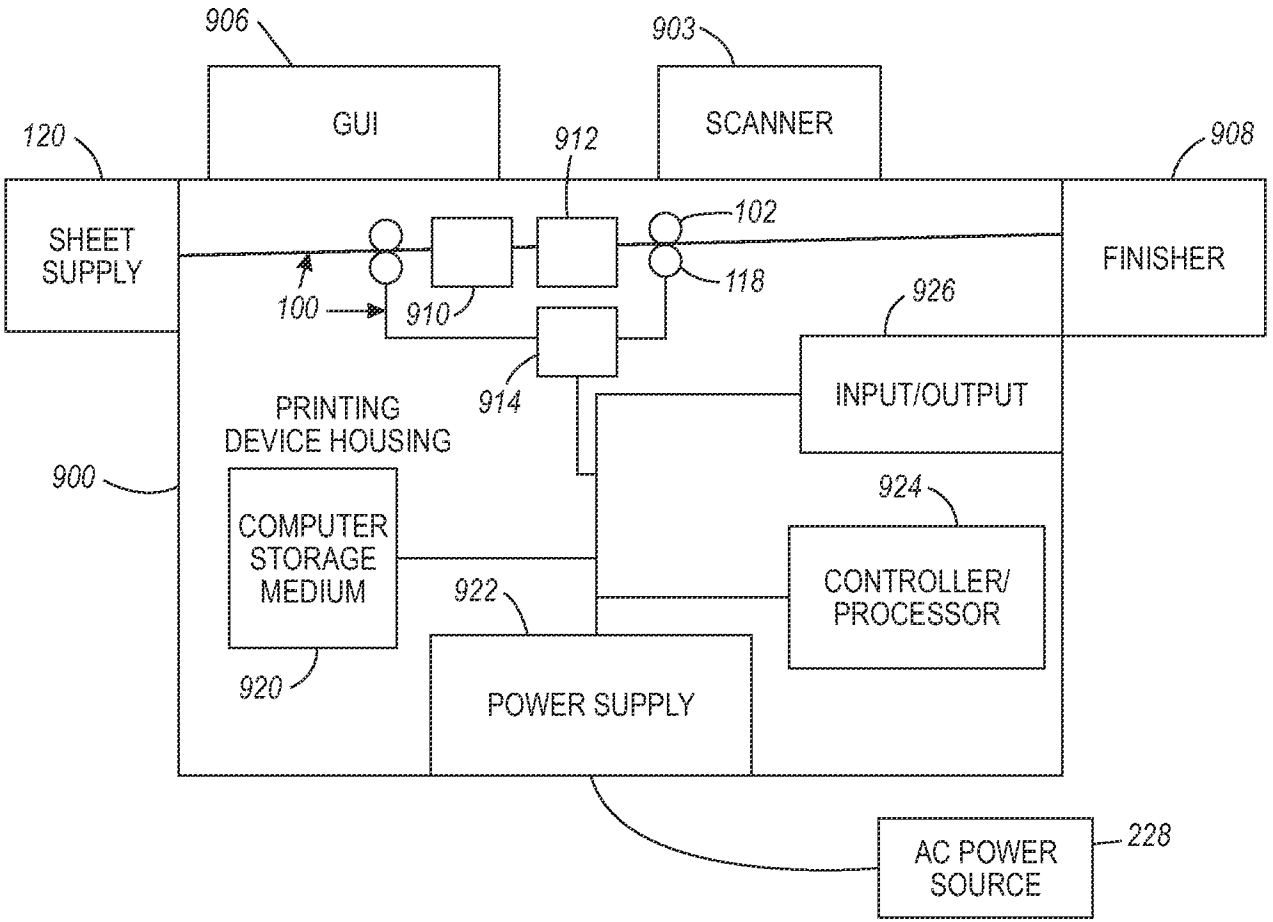
FIG. 11 is a schematic diagram of a printing device according to embodiments herein.

FIG. 11 illustrates a printing device 900, which can comprise, for example, a printer, copier, multi-function machine, etc., which can include the structures (nip 102, 118) shown in FIGS. 1-8. The printing device 900 includes a controller/processor 924, at least one marking device (printing engine) 910, 912, 914 operatively connected to the processor 924, a media path 100 positioned to supply sheets of media from a sheet supply 120 to the marking device(s) 910, 912, 914, and a communications port (input/output) 926 operatively connected to the processor 924 and to a computerized network external to the printing device. After receiving various markings from the printing engine(s), the sheets of media pass to a finisher 908 which can fold, staple, sort, etc., the various printed sheets.

Further, the printing device 900 includes at least one accessory functional component (such as a scanner/document handler 904, sheet supply 120, finisher 908, etc.) and graphic user interface assembly 906 that also operate on the power supplied from the external power source 928 (through the power supply 922).

An input/output device 926 is used for communications to and from the multi-function printing device 900. The processor 924 controls the various actions of the printing device. A computer storage medium 920 (which can be optical, magnetic, capacitor based, etc.) is readable by the processor 924 and stores instructions that the processor 924 executes to allow the multi-function printing device to perform its various functions, such as those described herein.

Thus, a printer body housing 900 has one or more functional components that operate on power supplied from the alternating current (AC) 928 by the power supply 922. The power supply 922 connects to an external alternating current power source 928 and converts the external power into the type of power needed by the various components.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A roller nip structure comprising:

a pair of rollers forming a nip, said rollers rotating in opposite directions to cause sheets of media to move along to a media path;

a first frame structure supporting a first roller of said pair of rollers, said first frame structure holding said first roller; and a second frame structure supporting a second roller of said pair of rollers, said second frame structure being adjustable in a first direction toward said first roller to move said second roller toward said first roller, said second frame structure having a variable pivot position such that said second frame structure automatically moves in a second direction perpendicular to said first direction to move said second roller in said second direction, said first frame structure being automatically adjustable in a third direction opposite said first direction toward said second roller to move said first roller toward said second roller, said first roller having a first axis about which said first roller rotates, said second roller having a second axis about which said second roller rotates, a straight reference line connects said first axis and said second axis when said first roller and said second roller are full size, said first frame structure keeping said first axis on said straight reference line, coordinated movement of said second frame structure in said first direction and said second direction keeps said second axis on said straight reference line as a size of said first roller and said second roller decrease because of wear, and said coordinated movement compensating for arc movement said second roller experiences because of said wear.

2. The roller nip structure according to claim 1, said second frame structure comprising: a pivot connection allowing said second frame structure to move in said first direction; and a series of openings into which said pivot connection connects, said series of openings allowing said pivot connection to move in said second direction.

3. The roller nip structure according to claim 1, said second frame structure comprising: a pivot connection allowing said second frame structure to move in said first direction; and a slot into which said pivot connection connects, said slot allowing said pivot connection to move in said second direction.

4. The roller nip structure according to claim 1, said second frame structure comprising: a pivot connection allowing said second frame structure to move in said first direction; and a screw mechanism to which said pivot connection connects, adjustment of said screw mechanism allowing said pivot connection to move in said second direction.

5. The roller nip structure according to claim 1, said second direction being perpendicular to said straight reference line.

6. The roller nip structure according to claim 1, further comprising a biasing member connected to said second frame structure for biasing said second frame structure in said first direction.

7. A printing apparatus comprising:

a marking device;

a media path positioned to supply sheets of media to said marking device; and a media supply tray positioned to supply said sheets of media to said media path, said media path comprising a pair of rollers forming a nip, said rollers rotating in opposite directions to cause said sheets of media to move along to said media path;

a first frame structure supporting a first roller of said pair of rollers, said first frame structure holding said first roller; and a second frame structure supporting a second roller of said pair of rollers, said second frame structure being adjustable in a first direction toward said first roller to move said second roller toward said first roller, said second frame structure having a variable pivot position such that said second frame structure automatically moves in a second direction perpendicular to said first direction to move said second roller in said second direction, said first frame structure being automatically adjustable in a third direction opposite said first direction toward said second roller to move said first roller toward said second roller, said first roller having a first axis about which said first roller rotates, said second roller having a second axis about which said second roller rotates, a straight reference line connects said first axis and said second axis when said first roller and said second roller are full size, said first frame structure keeping said first axis on said straight reference line, coordinated movement of said second frame structure in said first direction and said second direction keeps said second axis on said straight reference line as a size of said first roller and said second roller decrease because of wear, and said coordinated movement compensating for arc movement said second roller experiences because of said wear.

8. The printing apparatus according to claim 7, said second frame structure comprising: a pivot connection allowing said second frame structure to move in said first direction; and a series of openings into which said pivot connection connects, said series of openings allowing said pivot connection to move in said second direction.

9. The printing apparatus according to claim 7, said second frame structure comprising: a pivot connection allowing said second frame structure to move in said first direction; and a slot into which said pivot connection connects, said slot allowing said pivot connection to move in said second direction.

10. The printing apparatus according to claim 7, said second frame structure comprising: a pivot connection allowing said second frame structure to move in said first direction; and a screw mechanism to which said pivot connection connects, adjustment of said screw mechanism allowing said pivot connection to move in said second direction.

11. The printing apparatus according to claim 7, said second direction being perpendicular to said straight reference line.

12. The printing apparatus according to claim 7, further comprising a biasing member connected to said second frame structure for biasing said second frame structure in said first direction.

13. A printing apparatus comprising:

a marking device;

a media path positioned to supply sheets of media to said marking device;

a media supply tray positioned to supply said sheets of media to said media path;

a pair of rollers forming a nip adjacent said media supply tray, said rollers rotating in opposite directions to cause said sheets of media to move from said media supply tray to said media path;

a first frame structure supporting a first roller of said pair of rollers, said first frame structure holding said first roller; and a second frame structure supporting a second roller of said pair of rollers, said second frame structure being adjustable in a first direction toward said first roller to move said second roller toward said first roller, said second frame structure having a variable pivot position such that said second frame structure automatically moves in a second direction perpendicular to said first direction to move said second roller in said second direction, said first frame structure being automatically adjustable in a third direction opposite said first direction toward said second roller to move said first roller toward said second roller, said first roller having a first axis about which said first roller rotates, said second roller having a second axis about which said second roller rotates, a straight reference line connects said first axis and said second axis when said first roller and said second roller are full size, said first frame structure keeping said first axis on said straight reference line, coordinated movement of said second frame structure in said first direction and said second direction keeps said second axis on said straight reference line as a size of said first roller and said second roller decrease because of wear, and said coordinated movement compensating for arc movement said second roller experiences because of said wear.

14. The printing apparatus according to claim 13, said second frame structure comprising: a pivot connection allowing said second frame structure to move in said first direction; and a series of openings into which said pivot connection connects, said series of openings allowing said pivot connection to move in said second direction.

15. The printing apparatus according to claim 13, said second frame structure comprising: a pivot connection allowing said second frame structure to move in said first direction; and a slot into which said pivot connection connects, said slot allowing said pivot connection to move in said second direction.

16. The printing apparatus according to claim 13, said second frame structure comprising: a pivot connection allowing said second frame structure to move in said first direction; and a screw mechanism to which said pivot connection connects, adjustment of said screw mechanism allowing said pivot connection to move in said second direction.

17. The printing apparatus according to claim 13, said second direction being perpendicular to said straight reference line.

* * * * *